US006736143B2

(12) United States Patent
Rennecamp

(10) Patent No.: US 6,736,143 B2
(45) Date of Patent: May 18, 2004

(54) COMPACT SMOKING APPARATUS AND MANUFACTURE THEREOF

(75) Inventor: Bryan Rennecamp, 5621 Delmar Ave., Apt. 812, St. Louis, MO (US) 63112

(73) Assignee: Bryan Rennecamp, St. Louis, MO (US)

( * ) Notice: Subject to any disclaimer, the term of this patent is extended or adjusted under 35 U.S.C. 154(b) by 0 days.

(21) Appl. No.: 10/044,259

(22) Filed: Jan. 10, 2002

(65) Prior Publication Data

US 2002/0088469 A1 Jul. 11, 2002

Related U.S. Application Data

(60) Provisional application No. 60/260,783, filed on Jan. 10, 2001.

(51) Int. Cl.[7] ..... A24F 11/00; B65D 85/12

(52) U.S. Cl. ..... 131/240.1; 131/241; 131/242; 206/242

(58) Field of Search ..... 131/187, 191, 131/240.1, 241, 242; 206/242; 220/810, 345.1

(56) References Cited

U.S. PATENT DOCUMENTS

| | | | | |
|---|---|---|---|---|
| 498,695 | A | 5/1893 | Powell | |
| 842,065 | A | 1/1907 | Behran | |
| 1,444,308 | A | 2/1923 | Dunning | |
| 1,616,436 | A | 2/1927 | Bird | |
| 1,706,244 | A | 3/1929 | Meyerson | |
| 1,840,664 | A | 1/1932 | Gerstheimer | |
| 1,927,092 | A | 9/1933 | Howard | |
| 2,000,920 | A | 5/1935 | Campbell | 131/51 |
| 2,245,798 | A | 6/1941 | May | 215/1 |
| 2,506,385 | A | 5/1950 | Roamer | 206/48.5 |
| 3,233,951 | A | 2/1966 | Deal | 312/31.2 |
| 3,861,523 | A | 1/1975 | Fountain et al. | 206/236 |
| 4,207,976 | A | 6/1980 | Herman | 206/246 |
| 4,214,658 | A | 7/1980 | Crow | 206/244 |
| 4,667,688 | A | 5/1987 | Roig et al. | 131/329 |
| 4,793,478 | A | 12/1988 | Tudor | 206/256 |
| D339,348 | S | 9/1993 | Kuroda et al. | D14/191 |
| 5,277,304 | A | 1/1994 | Brizzi et al. | 206/256 |
| D351,681 | S | 10/1994 | Lechere | D27/189 |
| D352,602 | S | 11/1994 | Wendell | D3/230 |
| 5,465,738 | A | 11/1995 | Rowland | 131/329 |
| D368,326 | S | 3/1996 | Reid | D27/186 |
| 5,529,078 | A | 6/1996 | Rehder et al. | 131/329 |
| 5,711,423 | A | 1/1998 | Fuller, Jr. | 206/246 |
| D397,504 | S | 8/1998 | Zelenik | D27/187 |
| 5,810,164 | A | 9/1998 | Rennecamp | 206/256 |
| D399,600 | S | 10/1998 | Bowen et al. | D27/194 |
| D401,012 | S | 11/1998 | Montoya | D27/187 |
| 5,848,596 | A | 12/1998 | Zelenik | 131/329 |
| D409,329 | S * | 5/1999 | Bucher et al. | D27/189 |
| 5,967,310 | A | 10/1999 | Hill | 206/242 |
| 5,967,312 | A | 10/1999 | Jacobs | 206/266 |
| D416,106 | S | 11/1999 | Rennecamp | D27/189 |
| 6,070,591 | A | 6/2000 | Bryer | 131/233 |
| 6,474,342 | B1 * | 11/2002 | Rennecamp | 131/241 |

FOREIGN PATENT DOCUMENTS

| | | | |
|---|---|---|---|
| GB | 2236737 | 4/1991 | B65D/5/44 |

* cited by examiner

*Primary Examiner*—Steven P. Griffin
*Assistant Examiner*—Carlos Lopez
(74) *Attorney, Agent, or Firm*—Senniger Powers Leavitt and Roedel

(57) ABSTRACT

A compact wooden smoking apparatus wherein the body of the apparatus has a constant peripheral contour in cross sections taken in any plane generally parallel to the body top and body bottom. A wooden blank for use in the manufacture of a plurality of compact wooden smoking apparatuses, the wooden blank having a constant peripheral contour in cross sections taken in any plane generally perpendicular to its longitudinal axis. A method for manufacturing a compact wooden smoking apparatus involving milling an elongate piece of wood into an elongate wooden blank imparting a constant peripheral contour in cross sections taken in any plane generally perpendicular to a longitudinal axis of the piece of wood, and cutting lateral sections from the wooden blank to produce a plurality of smoking apparatus body sections.

1 Claim, 22 Drawing Sheets

COMPACT SMOKING APPARATUS AND MANUFACTURE THEREOF

This application claims priority from U.S. provisional patent application 60/260,783 filed Jan. 10, 2001.

BACKGROUND OF THE INVENTION

This invention relates to a smoking apparatus and, more particularly, to an apparatus which holds a smoking pipe and loose smoking material. The invention also relates to a milled wooden blank for use in manufacturing a smoking apparatus, and to a method for manufacturing a smoking apparatus.

There are many compact smoking systems in the prior art which are designed to help smokers reduce the amount of tobacco they smoke. Most of these systems have a base and a lid. The base generally has a receptacle for carrying loose smoking material and a pipe receptacle where a pipe is housed. The lid, in some fashion, covers openings to the receptacles in the base when closed, and exposes the receptacles in the base when the lid is in open position.

The pipe housed in the pipe receptacle is upwardly projected above the top edge of the base by the means of a spring when the lid uncovers the pipe receptacle. The vast majority are made out of wood, and have a design that makes them difficult to manufacture.

U.S. Pat. Nos. 4,214,658 and 5,465,738 disclose smoking systems in which a pipe is moved into accessible position by means of a resilient element when its cover is slid to the side. U.S. Pat. No. 5,967,310 discloses a smoking system with a pivotably mounted lid. The configuration of these prior designs does not facilitate simple manufacture.

Prior smoking systems had designs which included contours such that the depth and/or width of the systems changed in the linear direction from the top of systems to the bottom of the systems, such that they could not be manufactured in a simple operation using a multiple-head milling machine. For example, the lids in the slide-top versions shown in U.S. Pat. Nos. 4,214,658 and 5,465,738 flared outwardly from their top to their bottom. Other designs for pivot-top designs are shown, for example, generally in FIGS. 24–29 of the this application. With contours 26 and 27, these designs have a depth, from the front of the device body 21 to the back of the device body, which is not constant from the top of the device to the bottom. The contours 26 and 27 do not travel the entire length of the body. In particular, the shape of the body of the device near the top, where the contours 26 and 27 are, is not the same as the shape of the body below this contour. This aspect makes manufacture more difficult, and precludes simple manufacture using a multiple-head wood milling machine. These machines mill the same shape down the entire length of a piece of wood, and thus do not produce the shape shown in these figures. Additional wood shaping operations are required to produce the final product including contours 26 and 27. Moreover, sections 36 and 37 of the lid 22 (attached by fastener 28 seated in recess 10 at hole 25) must be machined into the lid to expose the full diameter of the receptacle 23 and receptacle 24 for pipe 15 when the lid is rotated, and cannot be machined into the lid in the same multiple-head milling operation which machines the body. These devices are therefore more time-consuming and costly to manufacture.

SUMMARY OF THE INVENTION

It is an object of the invention, therefore, to provide a simple smoking apparatus design that facilitates mass production; to provide such a design which facilitates mass production of a plurality of smoking apparatus body sections from a single piece of wood in a simple milling operation; to provide such a design which facilitates mass production of smoking apparatus body sections and smoking apparatus lids from a single piece of wood in a simple milling operation; and to provide such a design which facilitates production of smoking apparatuses using a multiple-head wood milling machine.

Briefly, therefore, the invention is directed to a compact wooden smoking apparatus comprising a smoking apparatus body having a body top, a body bottom, and body external side walls; wherein the body has a constant peripheral contour in cross sections taken in any plane generally parallel to the body top and body bottom; a smoking material receptacle in the body having a smoking material receptacle opening at the body top; and a lid for the smoking material receptacle, the lid having a lid top, a lid bottom, a lid width, lid depth, and lid external walls;

wherein the lid has a constant peripheral contour in cross sections taken in any plane generally parallel to the lid top and lid bottom.

The invention is also directed to a compact wooden smoking apparatus comprising a smoking apparatus body having a body top, a body bottom, and body external side walls; wherein the body has a constant peripheral contour in cross sections taken in any plane generally parallel to the top and bottom of the body; a smoking material receptacle in the body having a smoking material receptacle opening at the body top; and a lid for the smoking material receptacle, the lid being pivotably attached to the body top.

In another aspect the invention is a wooden blank for use in the manufacture of a plurality of compact wooden smoking apparatuses, the wooden blank comprising an elongate piece of milled wood comprising a first end; a second end remote from the first end; a longitudinal axis extending from the first end to the second end; a plurality of smoking apparatus body sections disposed between the first end and the second end; and a constant peripheral contour in cross sections taken in any plane generally perpendicular to said longitudinal axis.

The invention also includes a method for manufacturing a compact wooden smoking apparatus comprising milling an elongate piece of wood into an elongate wooden blank imparting a constant peripheral contour in cross sections taken in any plane generally perpendicular to a longitudinal axis of the piece of wood; cutting lateral sections of a first length from the wooden blank to produce a plurality of smoking apparatus body sections; and boring a smoking material receptacle into each of said plurality of smoking apparatus body sections.

Other objects and features will be in part apparent and in part pointed out hereinafter.

DETAILED DESCRIPTION OF THE PREFERRED EMBODIMENTS

Figure 1:
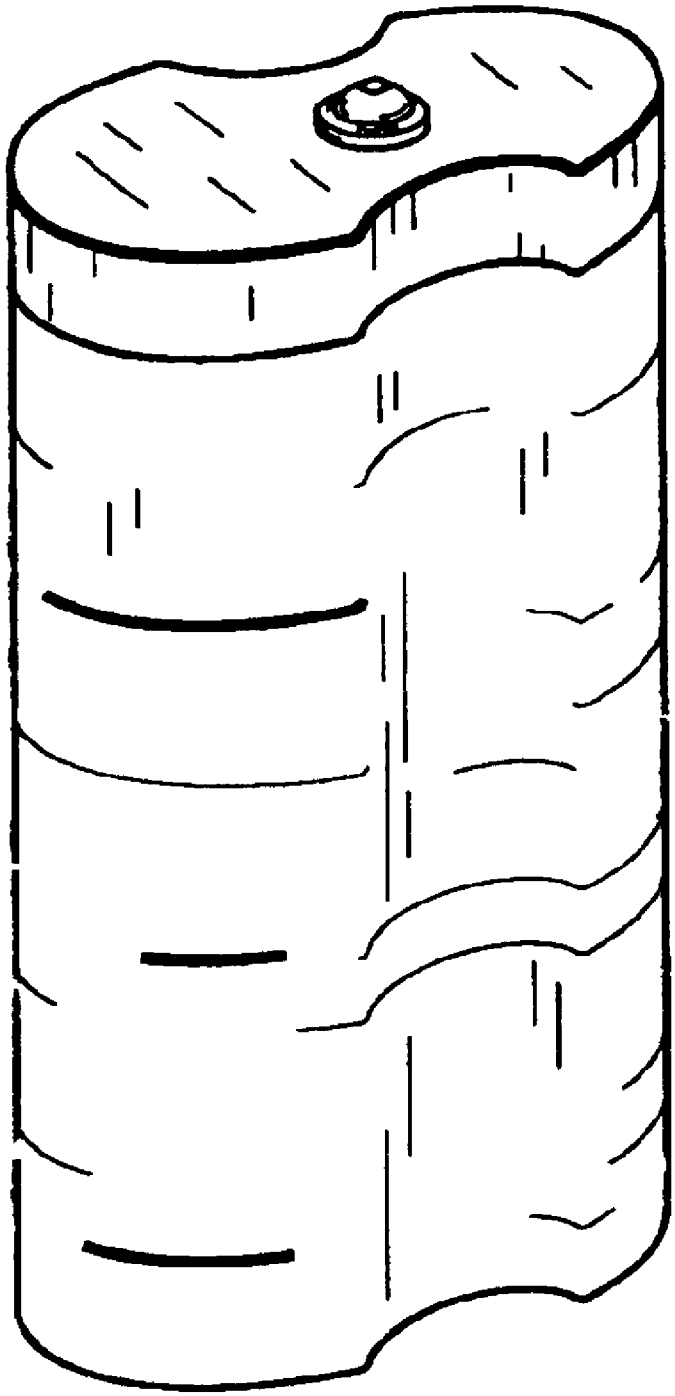
FIGS. 1, 4, and 7 are perspectives of fully assembled smoking apparatuses with pivotable lids in closed position.

The compact smoking apparatus of the present invention can advantageously be manufactured using a multiple-head wood milling machine. Such machines are used, for example, by wood mills to manufacture linear feet of wooden trim pieces such as baseboards, window casings, and crown moldings. Here, a multiple-head wood milling machine simultaneously utilizes multiple sets of custom made steel cutting knives to transform linear feet of lumber into a milled section of wood having the desired external shape of the smoking apparatus body, and preferably the smoking apparatus lid. The shape of the apparatus is therefore selected to be conducive to being shaped using a multiple-head wood milling machine having a shape which is constant throughout the entire length of the invention on both the body and the lid. This is to facilitate the capabilities of the wood milling machine, in that a multiple head wood milling machine mills a linear section of wood into a shape that is constant, i.e., such that the shape and contour of the resulting linear section do not change along a linear direction from one end of the section to the other end of the section.

One advantage of the process and product of the invention is speed of manufacturing. The machine can transform a twelve foot section of lumber into a shape capable of yielding, e.g., thirty to fifty smoking apparatus bodies in under a minute, or in even less time for high speed, state-of-the-art machines. Another advantage is the ease of applying early finish coats of paint or varnish, as it is easier to paint, for example, an eight foot linear section than to paint thirty-two individual three inch parts.

In one preferred embodiment, the smoking apparatus has a pivotably mounted lid consisting entirely of a shape that is formed using a multiple-head wood milling machine. Still more preferably, this lid has a profile corresponding to the profile of the smoking apparatus body, such that it is of a shape which is formed using the same machine as, at the same settings as, and formed simultaneously with the main body of the apparatus. In other words, the lid has an external shape and contour which do not change along the linear direction from the top of the lid to the bottom of the lid. Because the shape of the lid is the same down its entire side, there are no additional wood-shaping processes required in creating the lid exterior side wall shape other than one milling operation. In the preferred embodiment where the profile of the lid corresponds to the profile of the main body of the apparatus, there are similarly no additional wood-shaping processes required to create the lid and body exterior side wall shapes other than the single milling operation to produce the lid and apparatus body side wall shapes. The reduction in the number of shaping operations required to produce the exterior side wall shapes of the lid and main body correspond to faster and less expensive production. Moreover, this shape permits simultaneous access to both the pipe and tobacco receptacles when the lid is rotated 90° to an open position.

Figure 2:
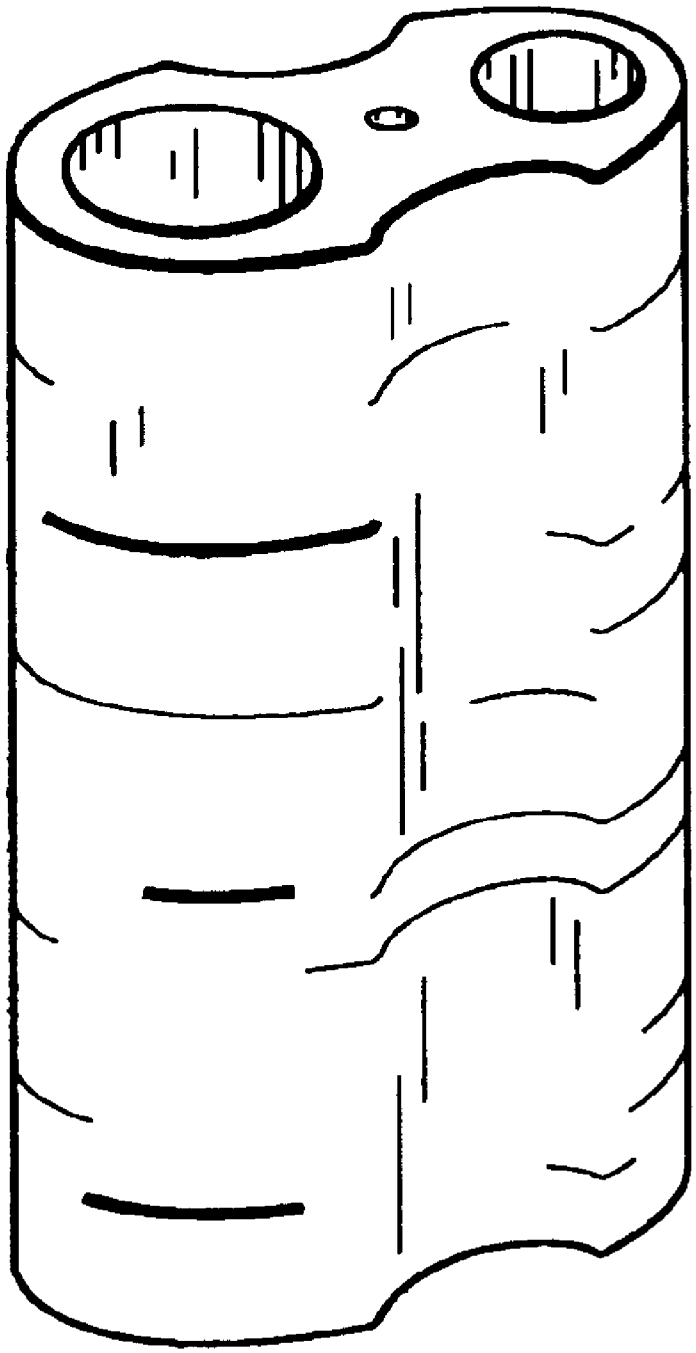
FIGS. 2, 5, and 8 are perspectives of the main body component of smoking apparatuses of the invention without attached lids.
Figure 3:
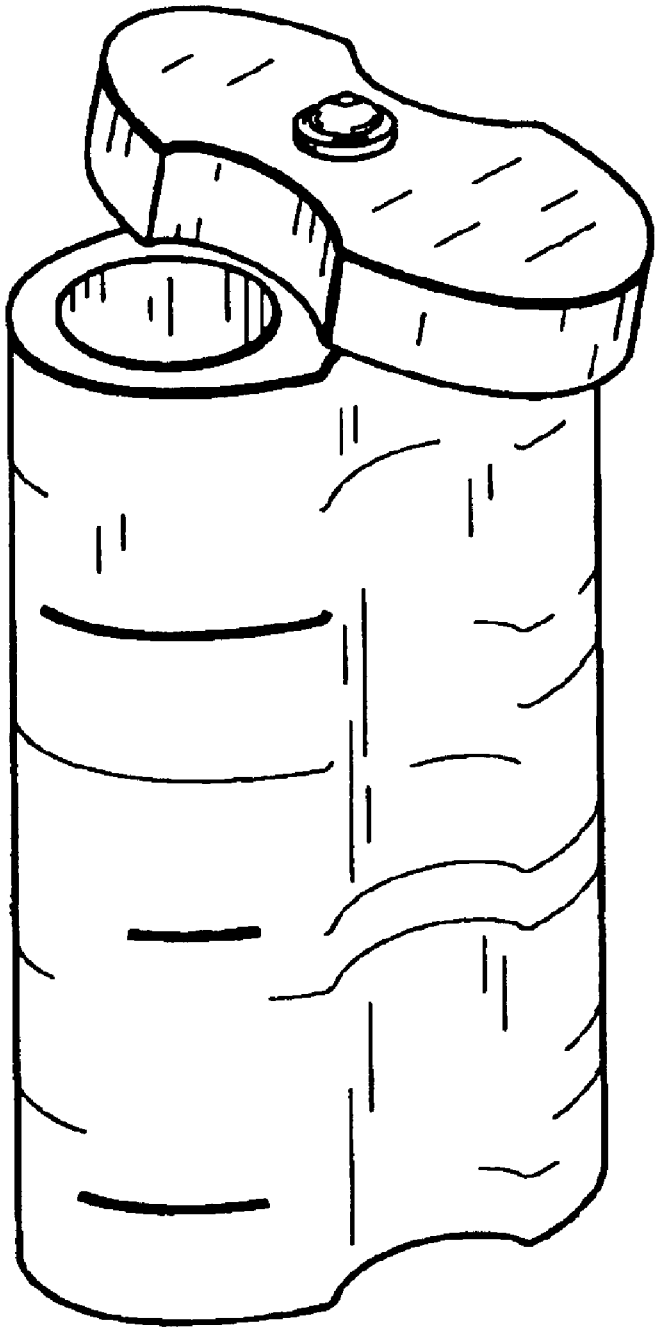
FIGS. 3, 6, and 9 are perspectives of fully assembled smoking apparatuses with pivotable lids in open position.
Figure 4:
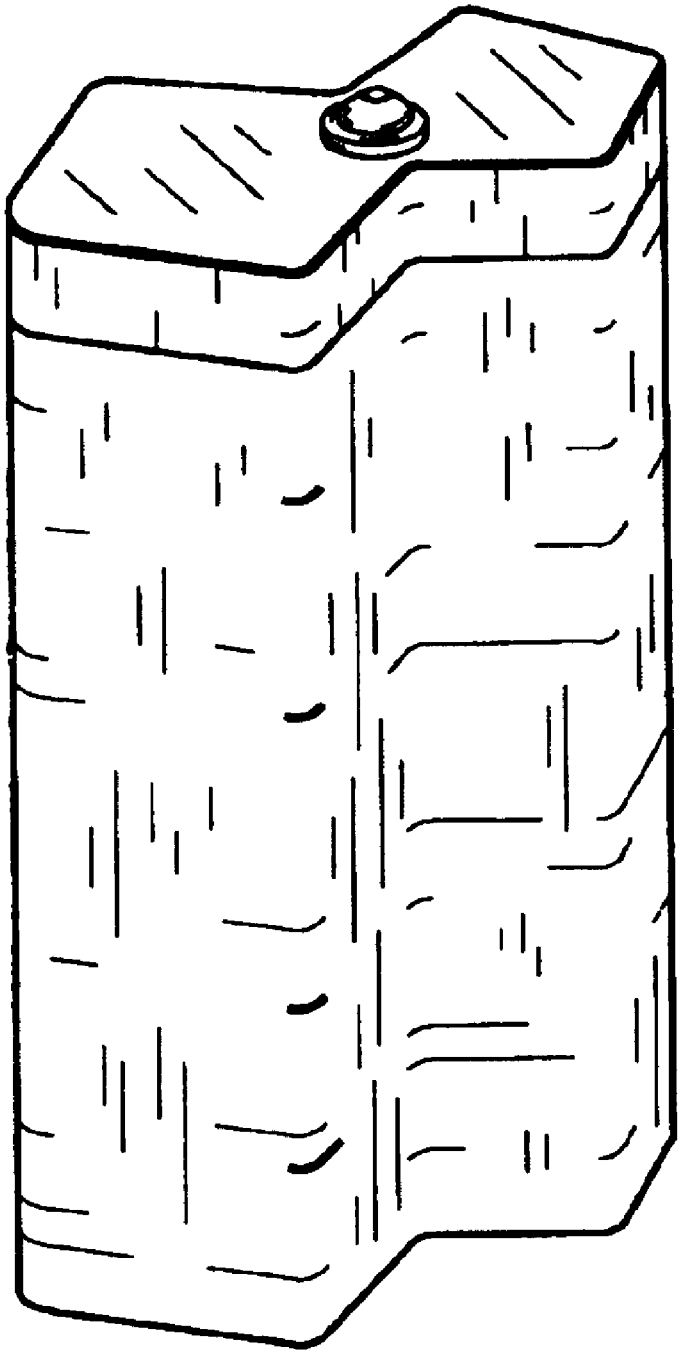
Figure 5:
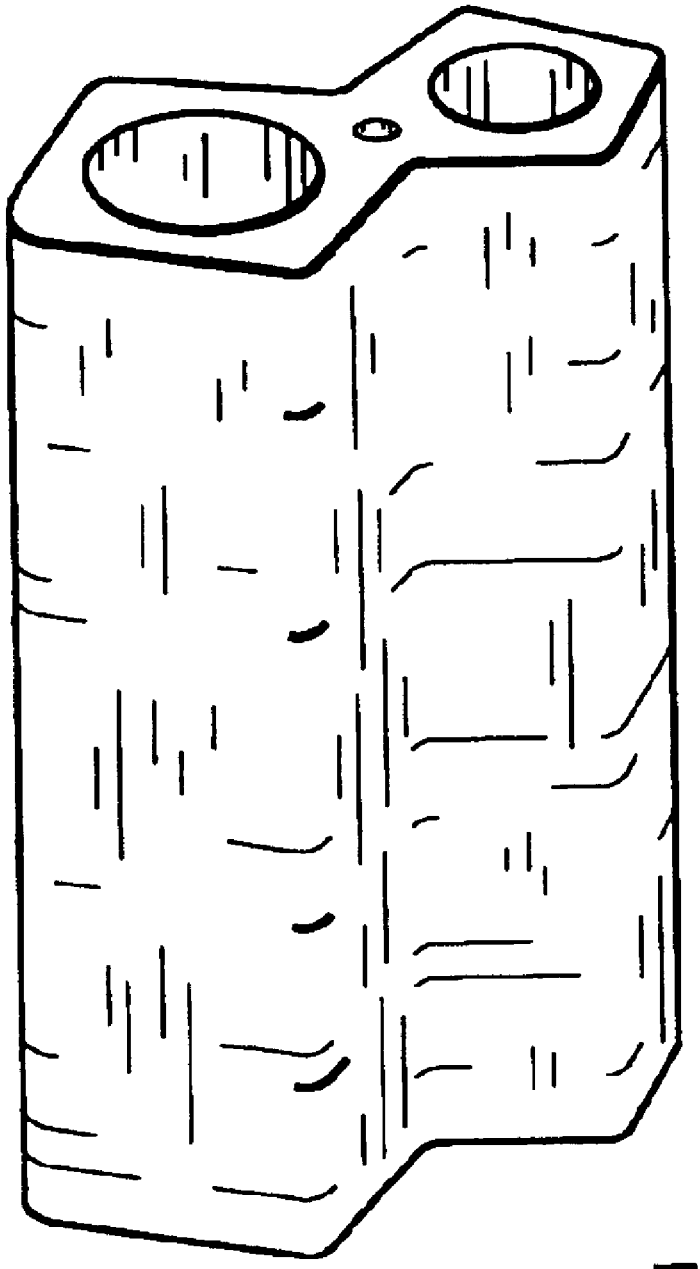
Figure 6:
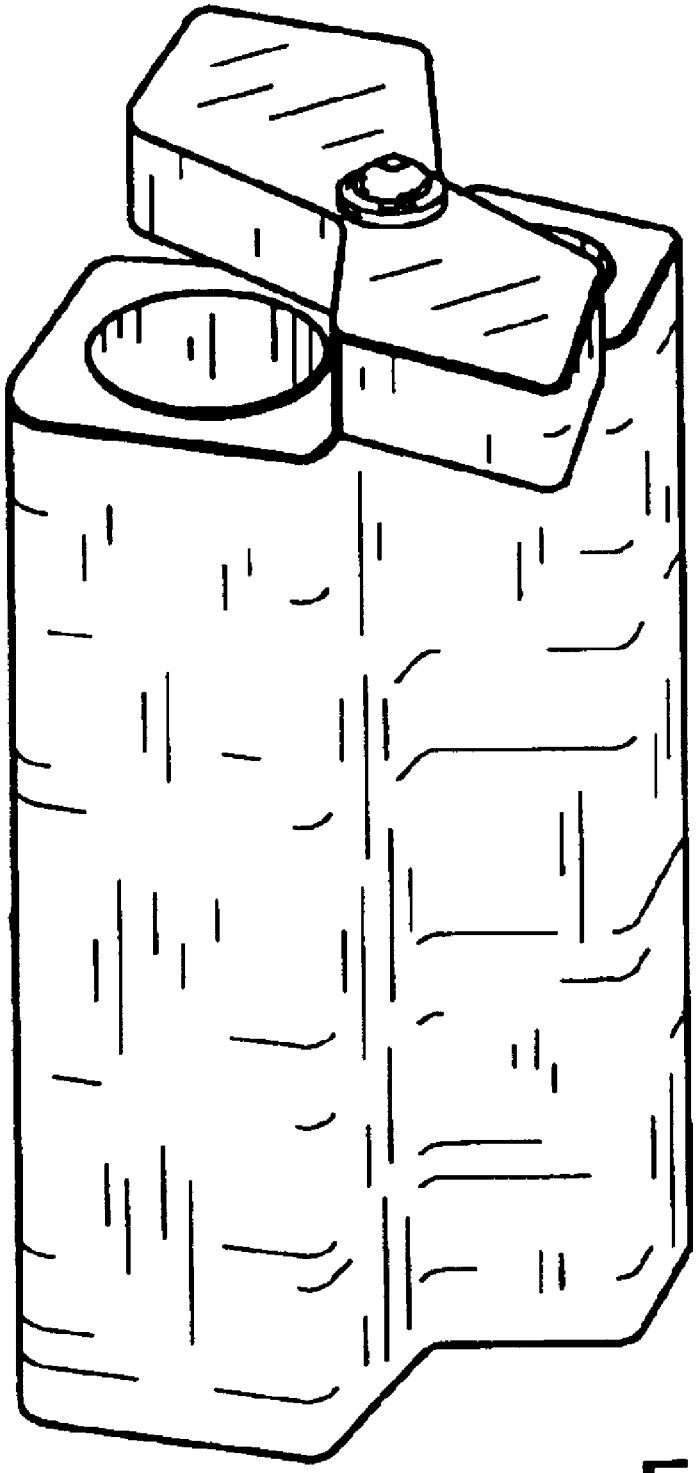
Figure 7:
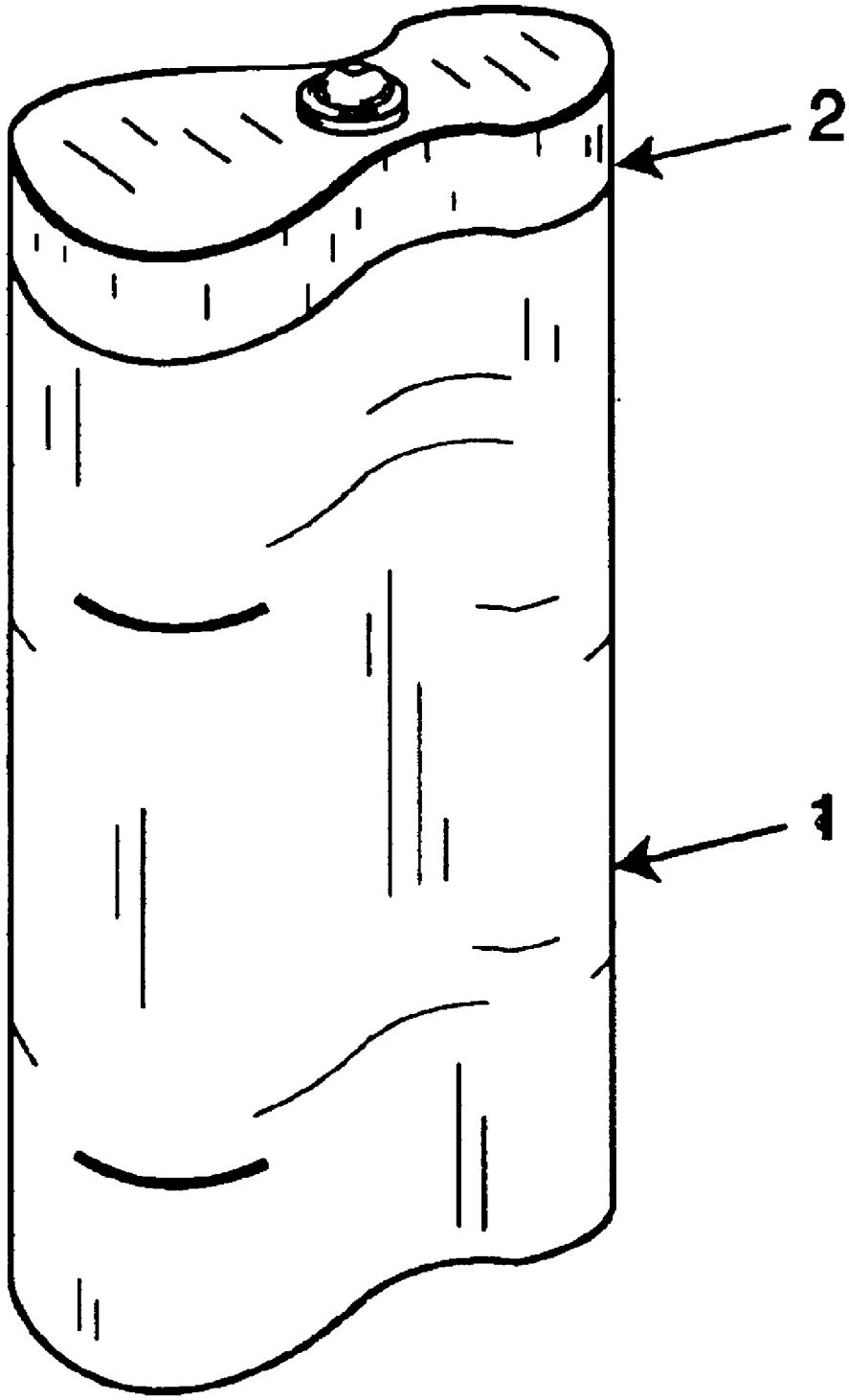
Figure 8:
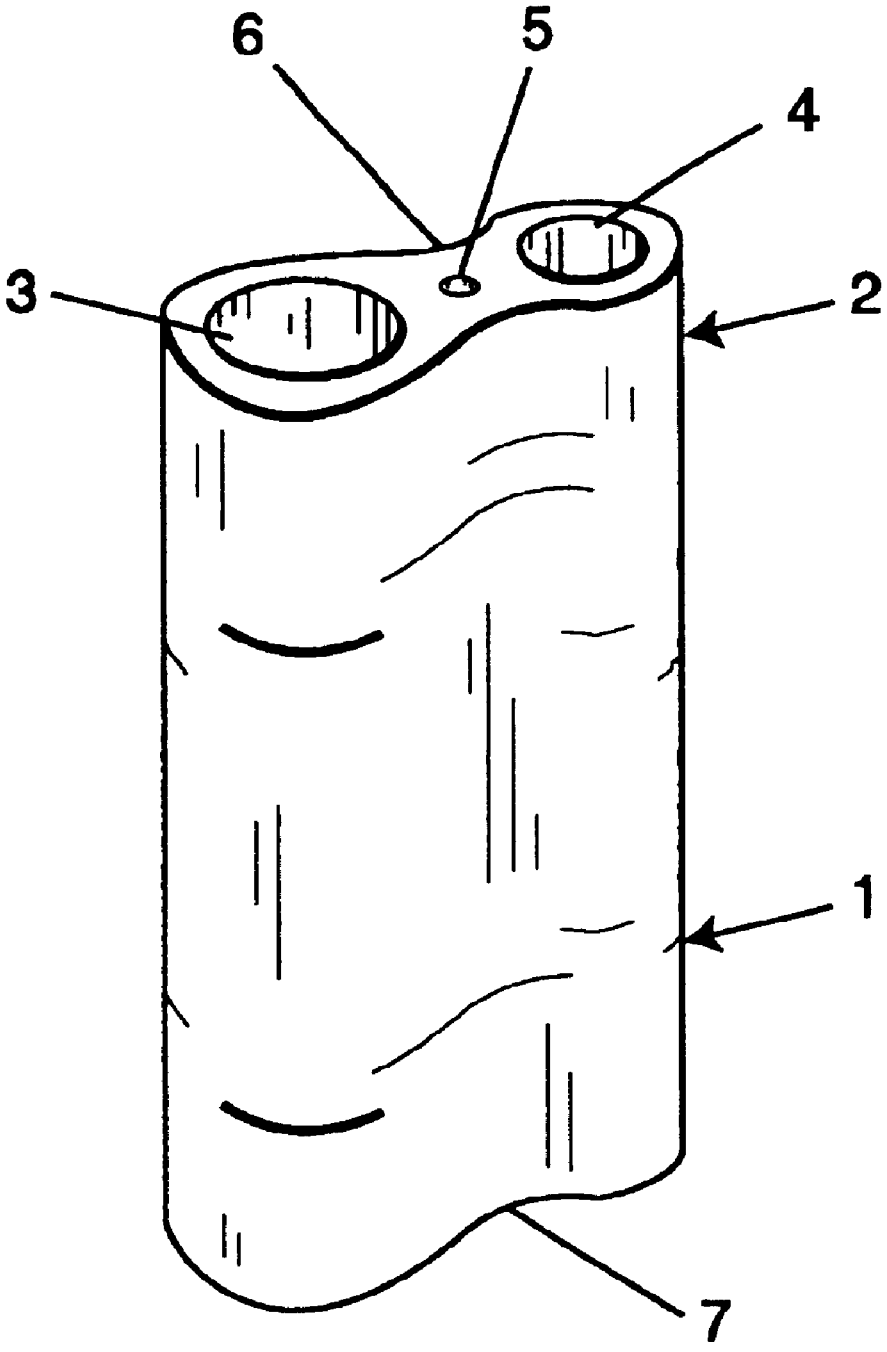
Figure 9:
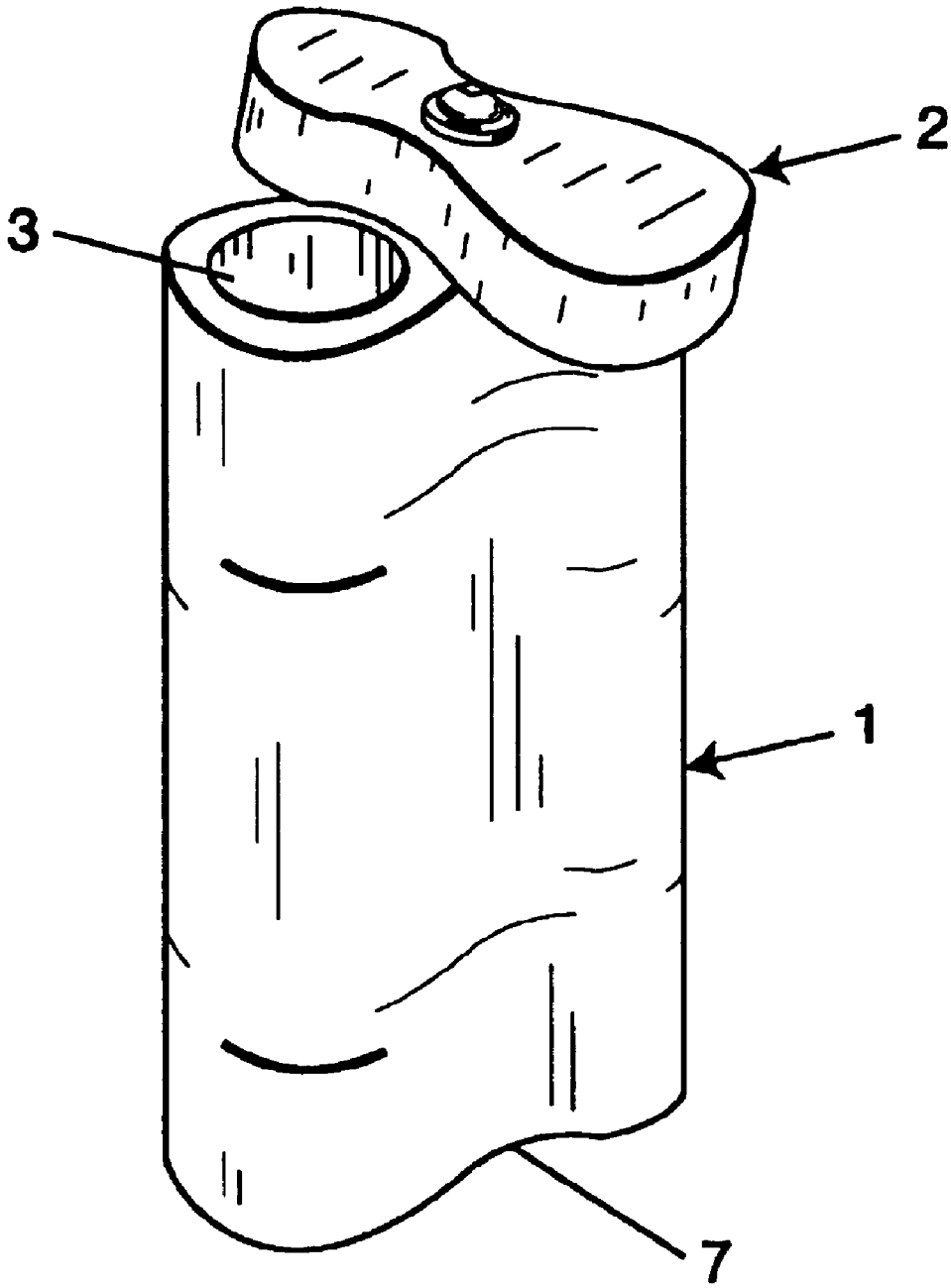
Figure 10:
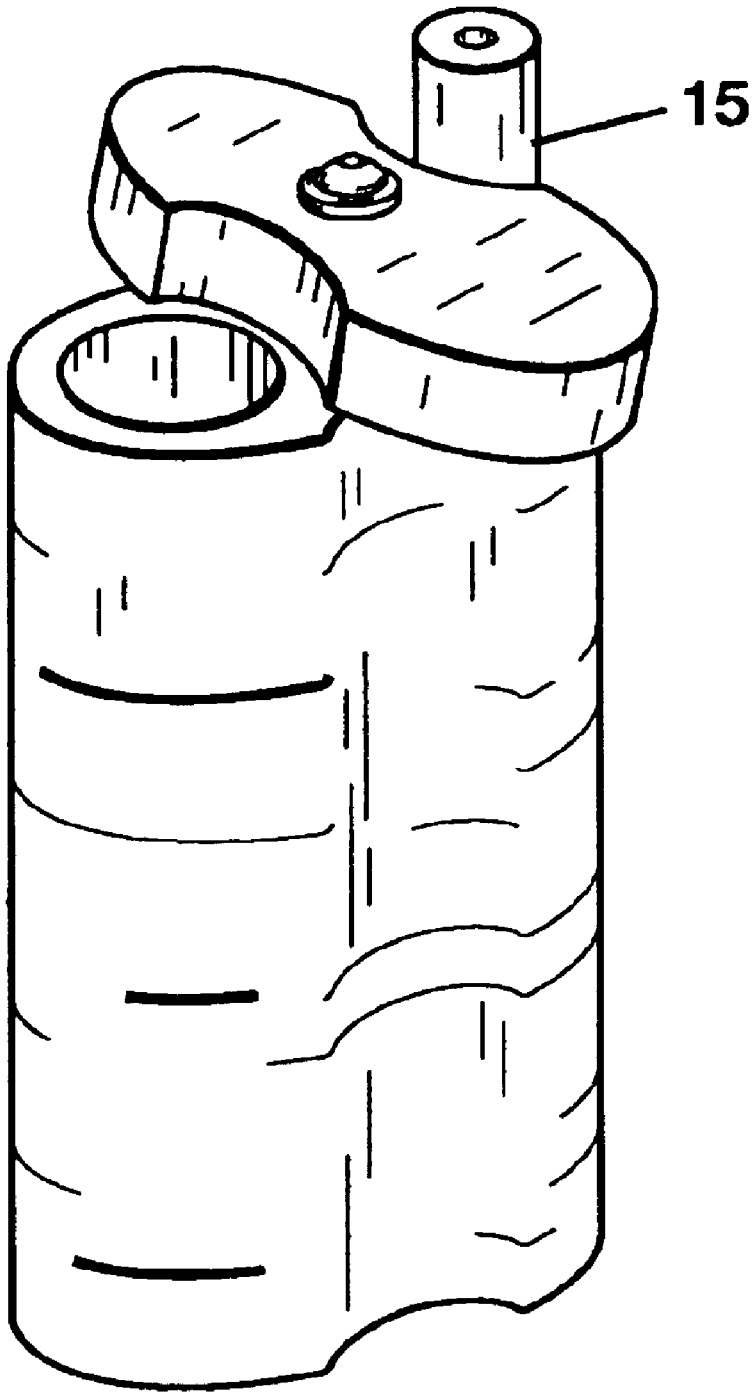
FIG. 10 is a perspective view of an embodiment of the invention with the lid in an open position with a pipe extending above the top edge of the body.

FIGS. 1–9 are all perspective views of certain preferred embodiments of the invention, though they are by no means exhaustive of the embodiments of the invention. FIGS. 1, 4, and 7 are perspectives of fully assembled smoking apparatuses with pivotable lids in closed position. FIGS. 3, 6, and 9 are perspectives of fully assembled smoking apparatuses with pivotable lids in open position. FIGS. 2, 5, and 8 are perspectives of the body components of smoking apparatuses of the invention without attached lids. As pointed out in FIGS. 1–3 and evident from examination of the other figures, the relieves, or contours located on the exterior side wall surfaces 6 and 7 extend the entire length of both the lid and the body. The external shape of each embodiment of the invention is constant from the top surface of the lid to the bottom surface of the body. This feature facilitates simple single-pass manufacture using a multiple-head wood milling machine on a length of wood to be sectioned into a large number of smoking apparatuses. The body and lid each have a constant peripheral contour in cross sections taken in any plane generally parallel to the top and bottom of each. By "generally parallel," it is encompassed that if the top of each is not parallel to the bottom of each, the planes from which the cross sections are taken are generally parallel to, for example, an average of the top and bottom. Stated another way, the external side walls of each of the lid and body do not change in a linear direction from the top of each to the bottom of each. And still another way, there is a constant peripheral contour in cross sections taken in any plane generally perpendicular to a centerline or longitudinal axis from the top of each to the bottom of each.

Figure 11:
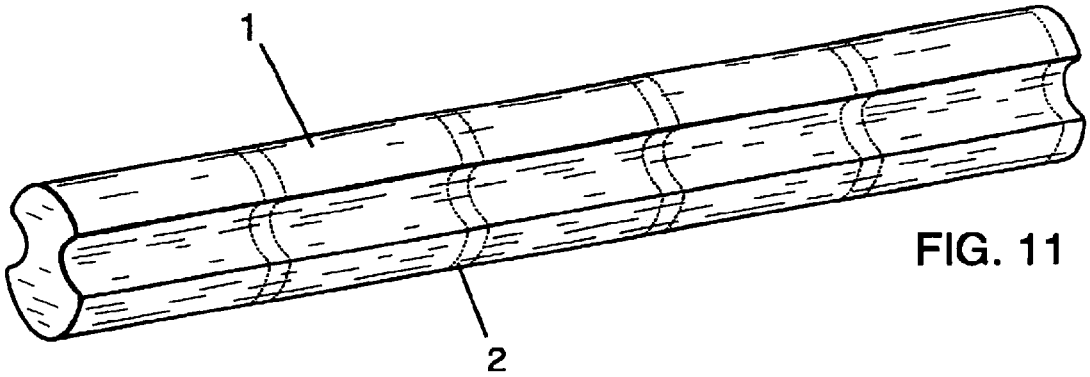
FIGS. 11–13 are perspective views of milled wooden blanks of the invention.
Figure 12:
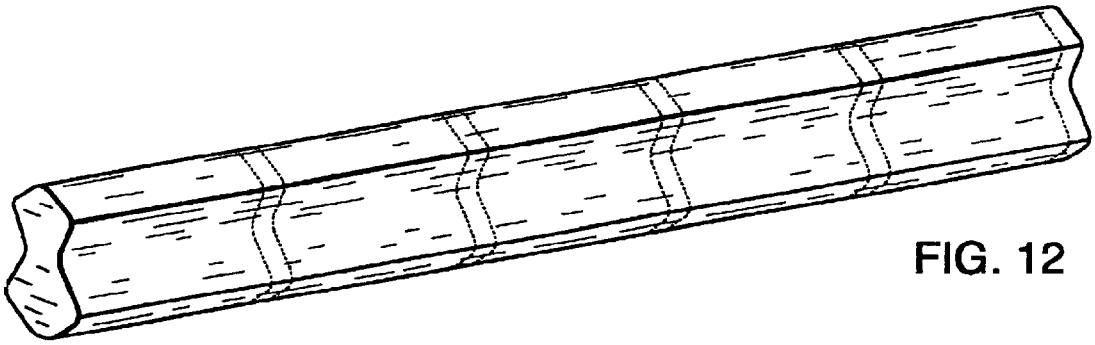
Figure 13:
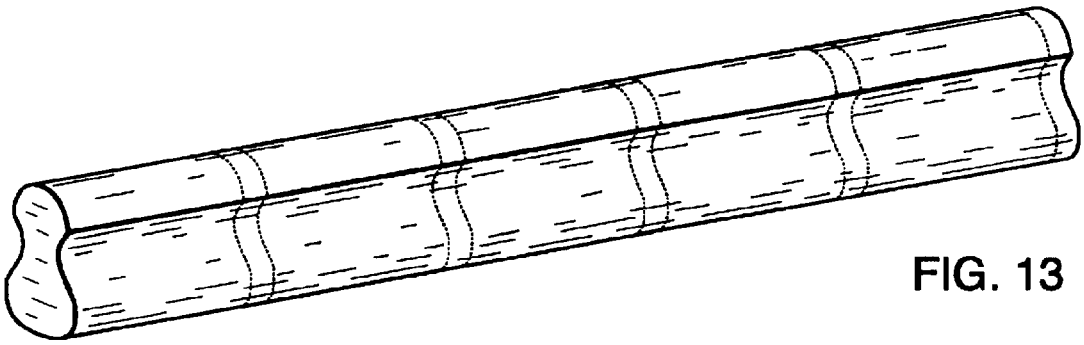
Figure 14:
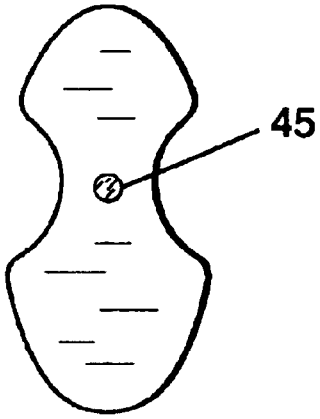
FIG. 14 is a bottom view of a smoking apparatus body of the invention.

FIG. 11 shows a wooden blank of the invention after being milled with a multiple-head wood milling machine into a shape that will be sectioned into several units of the body and lid of the smoking apparatus. The wooden blank is milled from a generally rectangular or other-shaped length of wood and is elongate in that it has a lengthwise dimension which is substantially larger than its width and depth. After the wood is milled into this wooden blank, in one preferred embodiment, bodies 1 and lids 2 are cut to length from the same blank as illustrated by the dashed lines in FIG. 11. FIGS. 12 and 13 illustrate alternative embodiments from which the apparatus of FIGS. 4 and 7 are sectioned.

FIG. 11 illustrates bodies and lids cut in alternating fashion from one piece of wood. This preferred embodiment has the added aesthetic advantage that in the finished product the wood grain in the lid matches up to the wood grain in the body. Alternatively, the lids and bodies are cut from completely different pieces of wood. Further alternatively, the lids and bodies are cut from the same piece of wood, but not necessarily in the alternating fashion shown in FIG. 11; for example, the lids are all cut from one end of the blank and the bodies are all cut from another end of the blank.

It is seen from these illustrations, therefore, that in one aspect the invention is a wooden blank for use in the manufacture of a plurality of compact wooden smoking apparatuses. The wooden blank comprises an elongate piece of milled wood having a first end, a second end remote from the first end, side walls having a shape and a contour which do not change along a linear direction from the first end to the second end, a plurality of smoking apparatus body sections of a first length disposed between the first end and the second end, and a plurality of smoking apparatus lid sections of a second length disposed between the first end and the second end. In other words, the blank has an constant peripheral contour in cross sections taken in any plane generally perpendicular to the longitudinal axis of the piece of wood. The second length is shorter than the first length. It is also seen that in one embodiment the body sections and lid sections are disposed alternatively along the wooden blank such that each of at least a plurality of the body sections are adjacent to lid sections.

In one preferred embodiment, the external side wall shape of the lid, which corresponds to the external side wall shape of the body, allows the full diameter of both the smoking material receptacle and pipe receptacle to be simultaneously exposed when the pivotably mounted lid is rotated ninety degrees in relation to the body to an open position. This is the reason for the contours on the front and back surfaces on both the body and the lid 6 and 7 of the smoking apparatus. While these contours are not necessary on the body, the capabilities of a multiple-head wood milling machine dictate that an elongate section of lumber be milled into the same constant shape. The contours on the front and back surfaces also serve ergonomic and aesthetic purposes.

Figure 23:
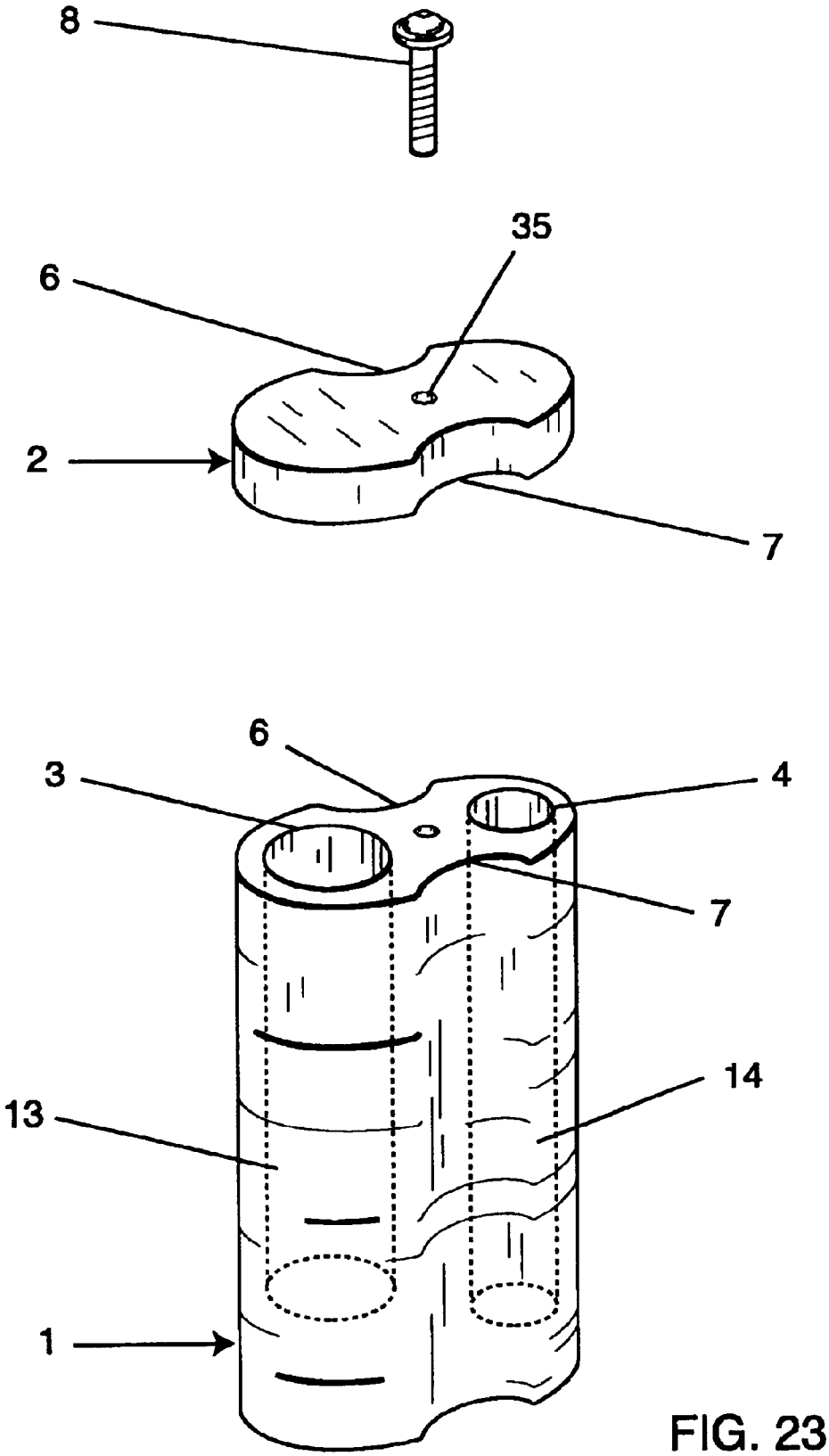
FIG. 23 is an exploded perspective view of the attachment screw, lid, and smoking apparatus body of the invention.
Figure 24:
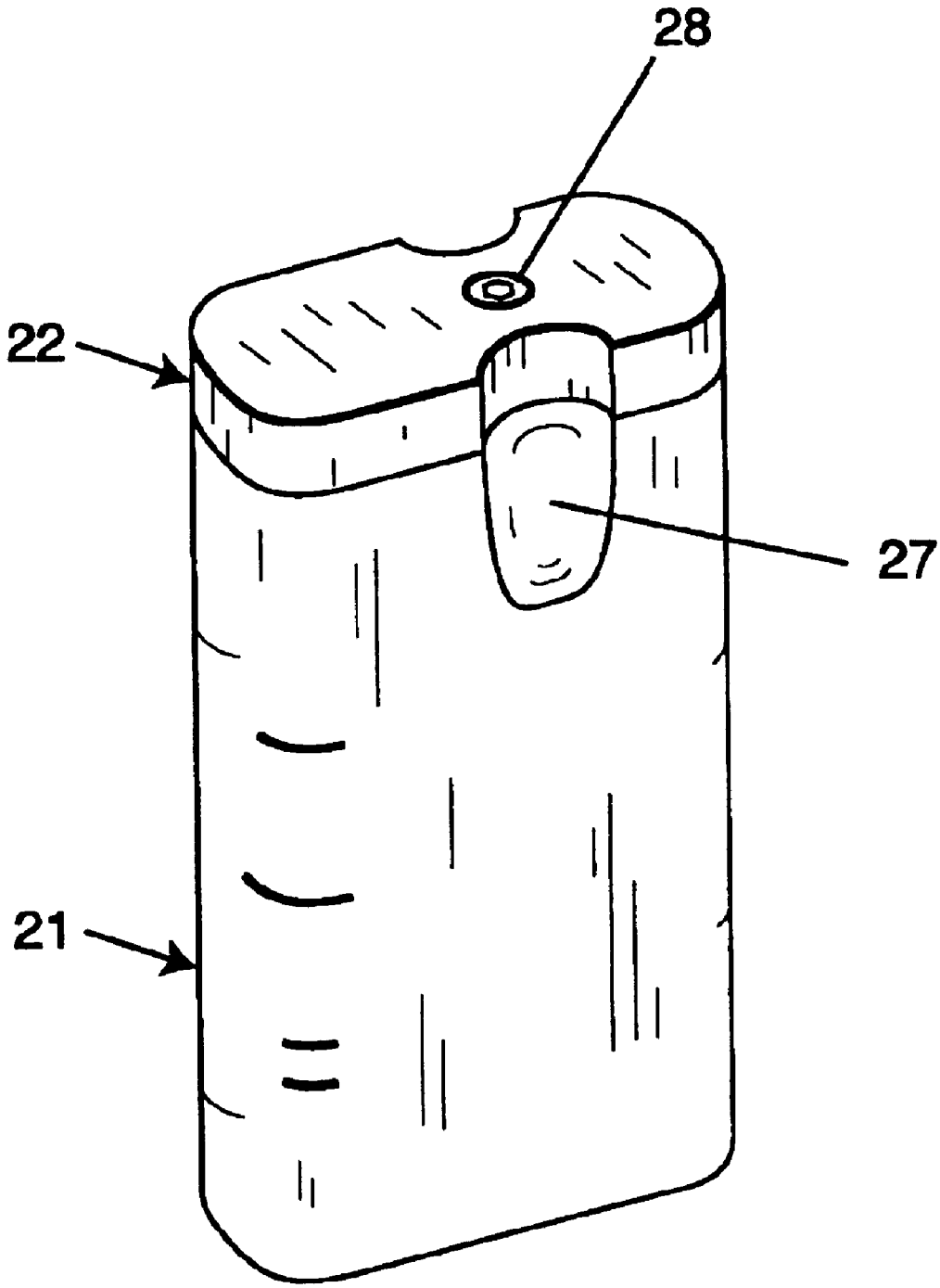
FIG. 24 ( PRIOR ART )
FIGS. 24 and 26 are perspective views of a prior art smoking apparatus.
Figure 25:
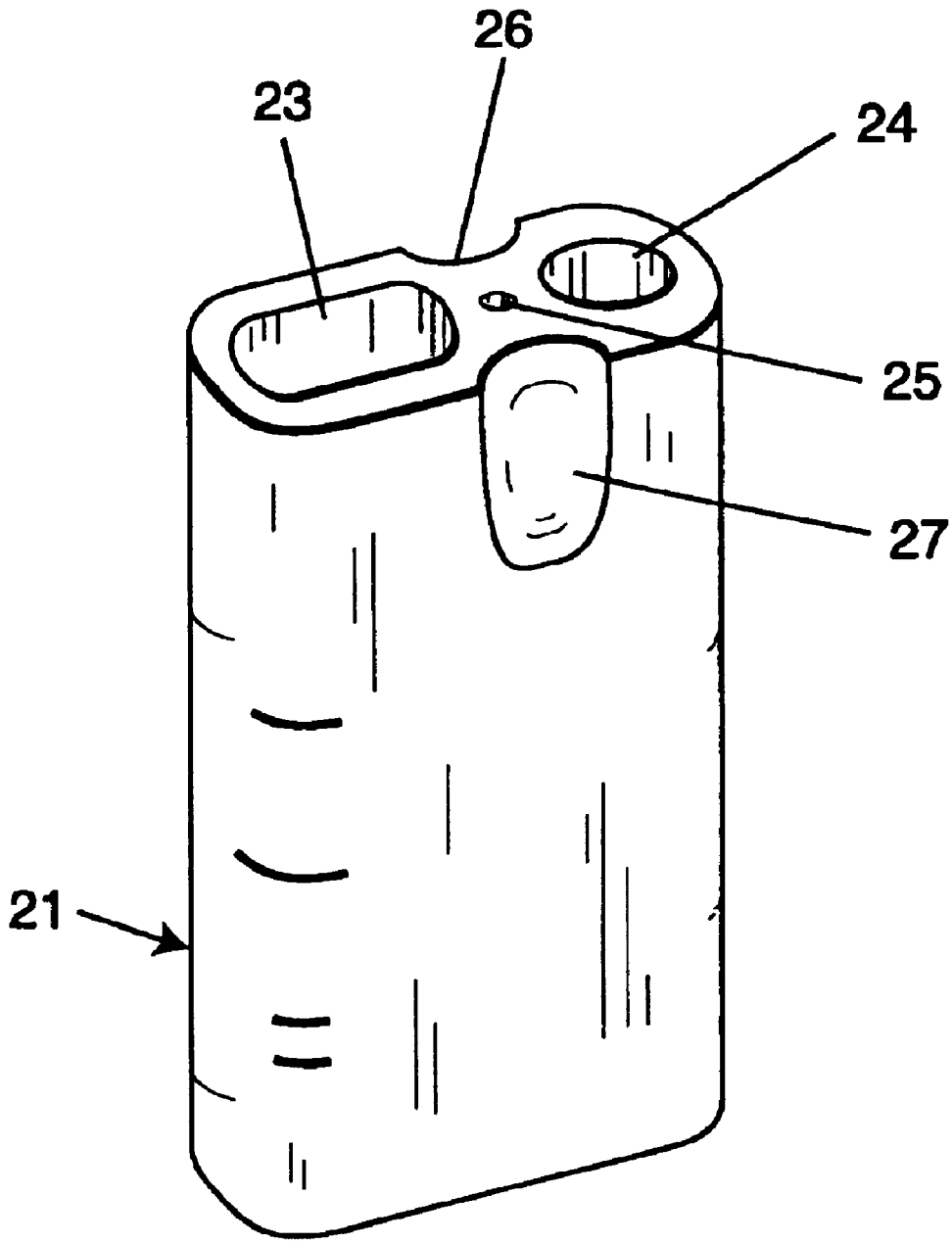
FIG. 25 ( PRIOR ART )
FIG. 25 is a perspective view of a body portion of a prior art smoking apparatus.
Figure 26:
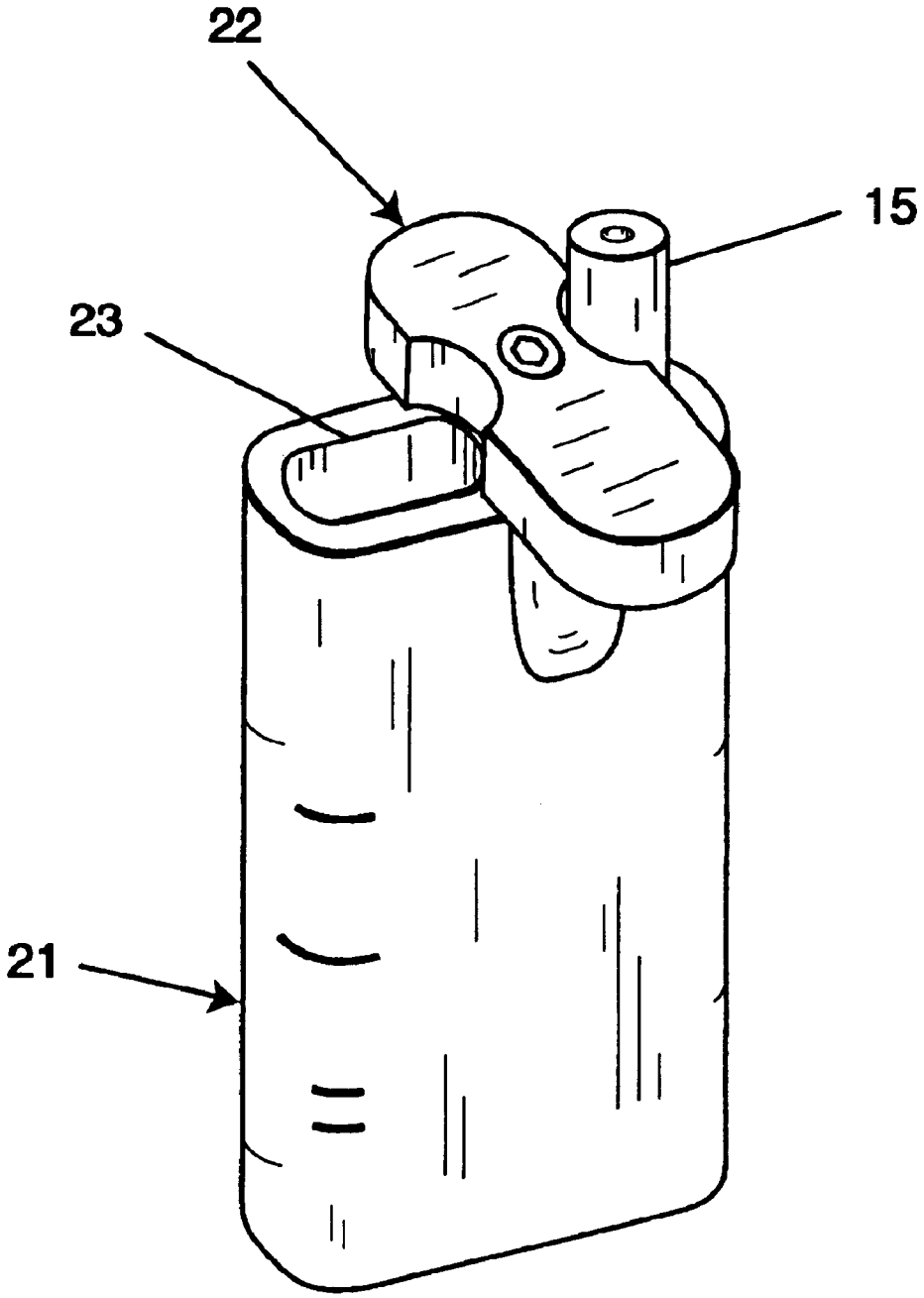
FIG. 26 ( PRIOR ART )
Figure 27:
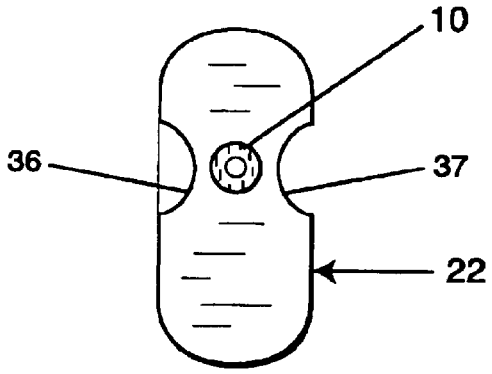
FIG. 27 ( PRIOR ART )
FIG. 27 is a top view of a lid of a prior art smoking apparatus.
Figure 28:
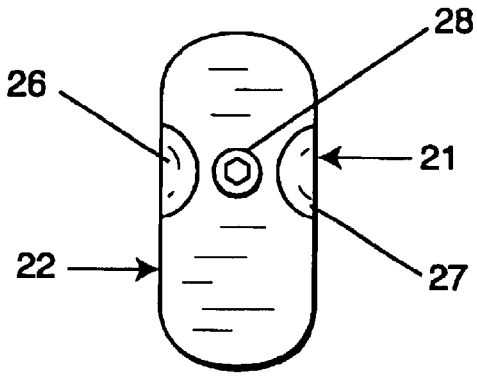
FIG. 28 ( PRIOR ART )
FIGS. 28 and 29 are top views of a prior art smoking apparatus with lid attached to body.
Figure 29:
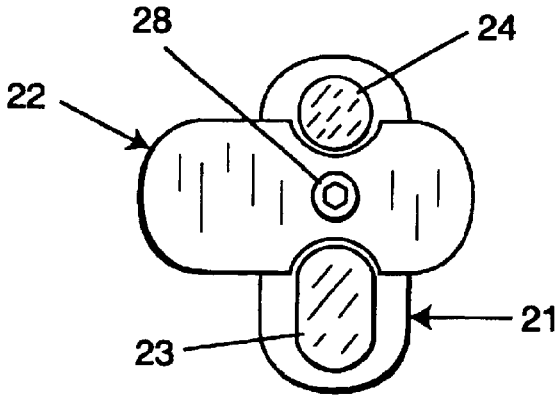
FIG. 29 ( PRIOR ART )

Some secondary drilling operations are performed after cutting the linear feet into lengths approximating the desired height of a single body. In particular, receptacles for smoking material and a pipe are bored into the body as indicated at the openings 3 and 4 in FIG. 15, and as is known from U.S. Pat. Nos. 4,214,658; 5,465,738; and U.S. Pat. No. 5,810,164. These receptacles are illustrated in phantom at 13 and 14 of FIGS. 21 and 23. The smoking material receptacle is preferably greater in diameter, and shorter in length, as compared to the pipe receptacle. The pipe receptacle also houses a spring near the bottom of the receptacle. A spring upwardly biases the top edge of the pipe above the top edge of the body 1 when the lid, which serves as closure for the pipe and smoking material receptacles, is moved to open position.

Figure 16:
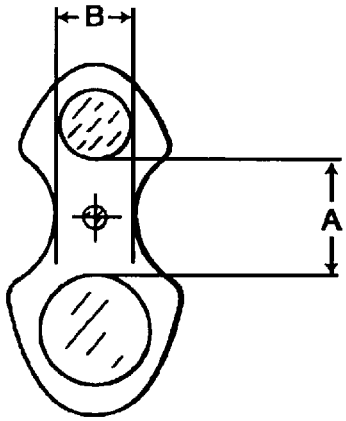

FIG. 16 illustrates that in a preferred embodiment the distance (A) between the smoking material receptacle opening and the pipe receptacle opening in the body is greater than width (B) of the body and the like width of the lid at the pivot point. If B were greater than A, portions of the smoking material receptacle opening 3 and the pipe receptacle opening 4 would still be covered when the lid is rotated ninety degrees to an open position. It is seen, therefore, that the pipe receptacle opening is a distance from the smoking material receptacle opening, which distance is greater than the lid depth width. This feature provides unobstructed access to the smoking material receptacle opening and pipe receptacle opening upon rotation of the lid to an open position.

Figure 15:
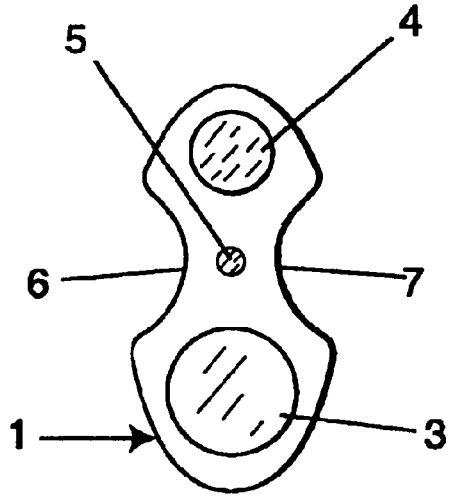
FIGS. 15–17 are top views of a smoking apparatus body of the invention.

FIGS. 14–18 illustrate how the external shape of a single end product is dictated by both the secondary procedures needed to make a single product as well as the criteria that must be met allowing a design wherein the lid 2 and the body 1 have an identical external shape capable of being manufactured using a multiple-head wood milling machine. FIG. 15 shows the body 2 must be of sufficient size to contain the full diameters of both the smoking material receptacle opening 3 and the pipe receptacle opening 4. Another cavity in the body is simply a pilot hole 5 to facilitate attachment of a pivotably mounted lid. The pilot hole on the top surface of the body 5 is located between the two contours on the front and back surfaces of the body 6 and 7.

Figure 17:
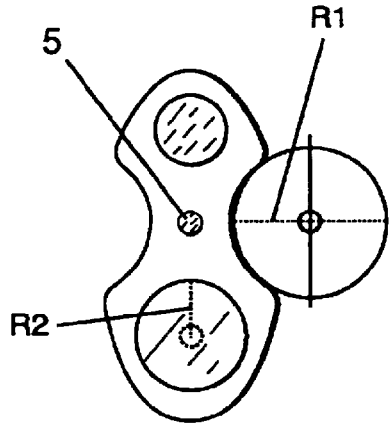
Figure 18:
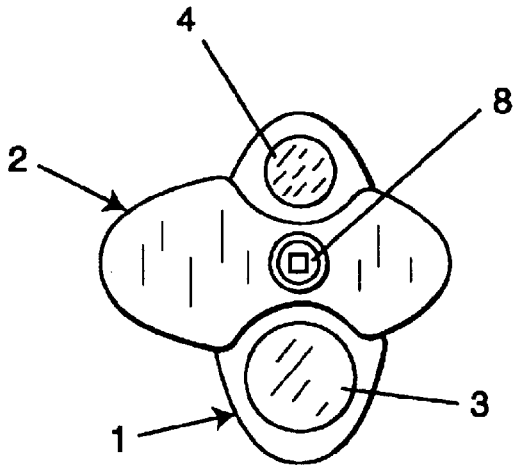
FIG. 18 is a top view of a smoking apparatus of the invention with a lid attached to the smoking apparatus body and the lid rotated to an open position.

FIG. 18 is a top view of the invention with the lid 2 rotated ninety degrees to an open position. The lid is pivotably mounted in this particular embodiment by means of a pan head washer type screw 8. The shape of the lid 2, which is identical to the shape of the body 1, allows the full diameter of both the smoking material receptacle opening 3 and the pipe receptacle opening 4 to be exposed when rotated to an open position. To further ensure that full diameters of the openings in the body are exposed when the lid is rotated to an open position, in this embodiment the radius of the external side wall contours is greater than the radius of the smoking material receptacle opening as illustrated in FIG. 17. Accordingly, the smoking apparatus side walls have a generally arcuate contour having a contour radius dimension R1. The smoking material receptacle opening is circular, oval, or of another shape which has an arcuate section at a point on the opening closest to a center point of the smoking apparatus body. There is a smoking material receptacle radius dimension R2 corresponding to this arcuate section. The contour radius dimension R1 is greater than the smoking material receptacle dimension R2.

Since both the body and the lid are milled from linear feet of lumber, the natural wood grain runs vertically through both the body and the lid. This means that the end grain of the wood is exposed on both the top and bottom surfaces of both the body and the lid. This is not a problem on the noticeably larger section that comprises the body. The lid, however, with the end grain exposed on the top and bottom surfaces, has less strength than another lid of identical thickness where the natural wood grain is parallel to the front and back of the surface of the lid. The lid proposed in this invention is roughly the same thickness as others on the market.

Figure 19:
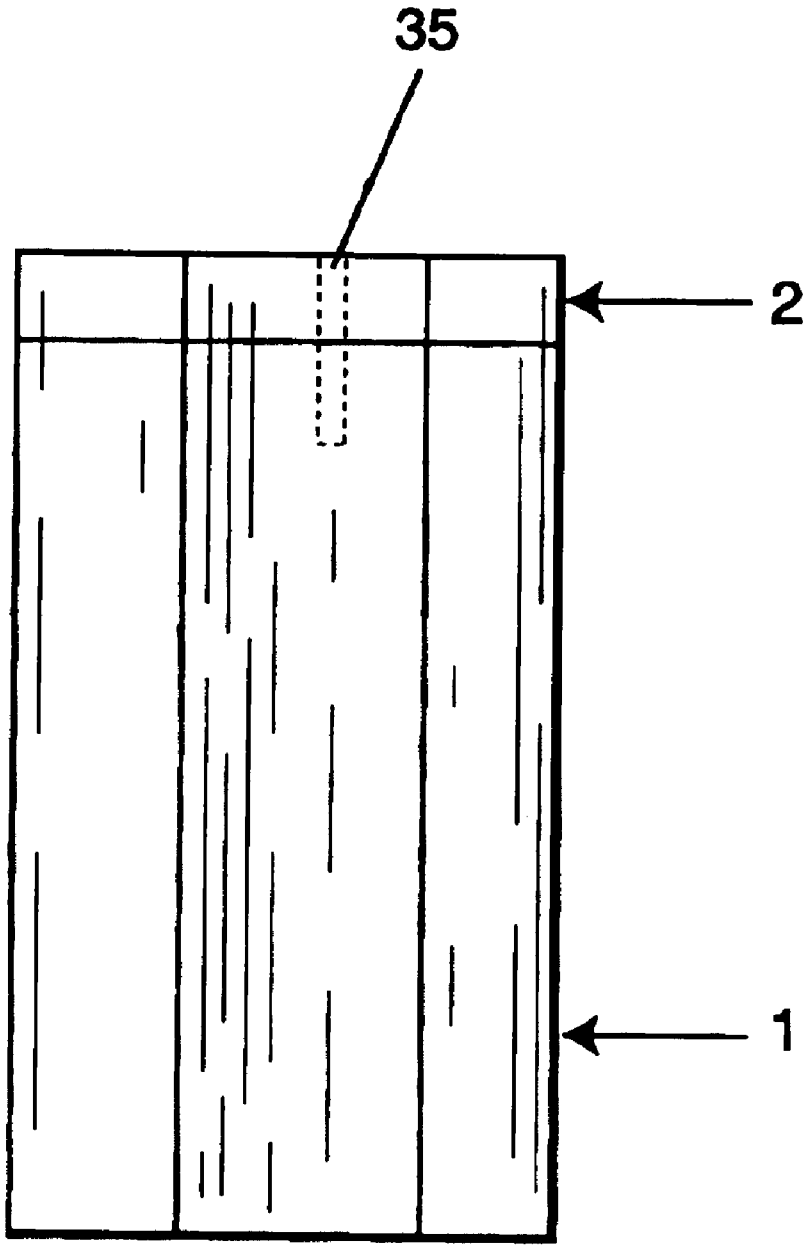
FIG. 19 is a front elevation of the smoking apparatus of the invention illustrating in phantom a hole for attachment of the lid to the smoking apparatus body.
Figure 20:
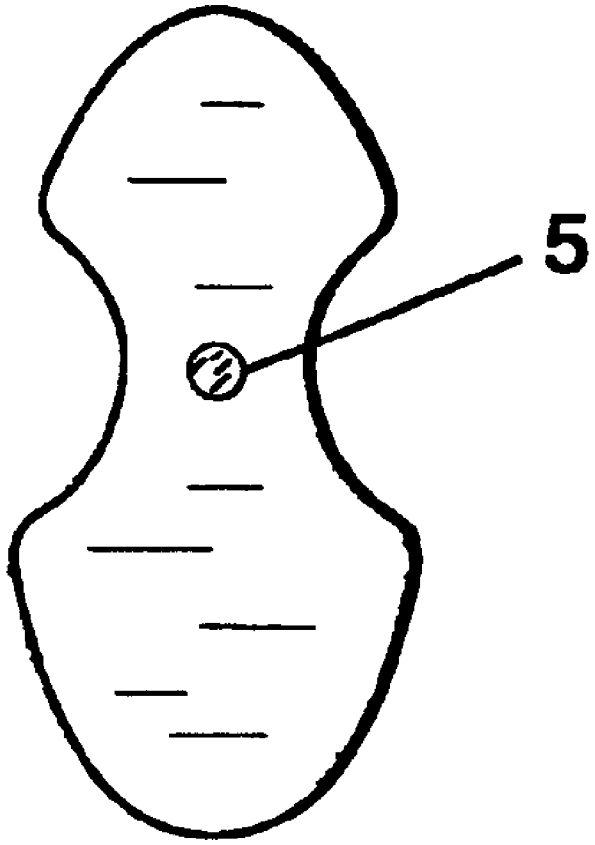
FIG. 20 is a bottom view of smoking apparatus of claim 19.

Concerns with regard to structural strength of the lid, therefore, are addressed in one aspect by selection of the type of fastener that attaches the lid to the body at the pivot point. Generally, prior smoking apparatuses having a pivotally mounted lid use either a countersunk flathead screw or a countersunk socket head cap screw. However, the structurally weakest section of the lid is the location of the pivot point at the lid. Removing extra wood for a countersunk screw on the top of the lid at the pivot point only makes the lid more fragile. This invention, therefore, uses a different type of fastener that does not require a countersunk hole, so less wood is removed from the weakest part of the lid. This decreases the likelihood of the lid breaking during usage. One preferred fastener is a pan head washer type screw. This type of screw offers two specific advantages for this application. There is no need to countersink the screw, leaving more wood material at the weakest part of the lid. Also, the pan head washer type of screw gets its name from the integrated washer on the underside of the screw head. This integrated washer allows the fastener to exert downward pressure more evenly across the top of the lid, allowing a tighter seal between the body and the lid when the lid is covering the openings in the body. By utilizing a fastener wherein the bottom surface of the head of the fastener contacts the top of the surface of the lid, there is no need for a countersunk hole. Only a small pilot hole 35 is required leaving more material as part of the lid bolstering the structural integrity of the weakest part of the lid as shown in FIGS. 19 and 20.

Figure 21:
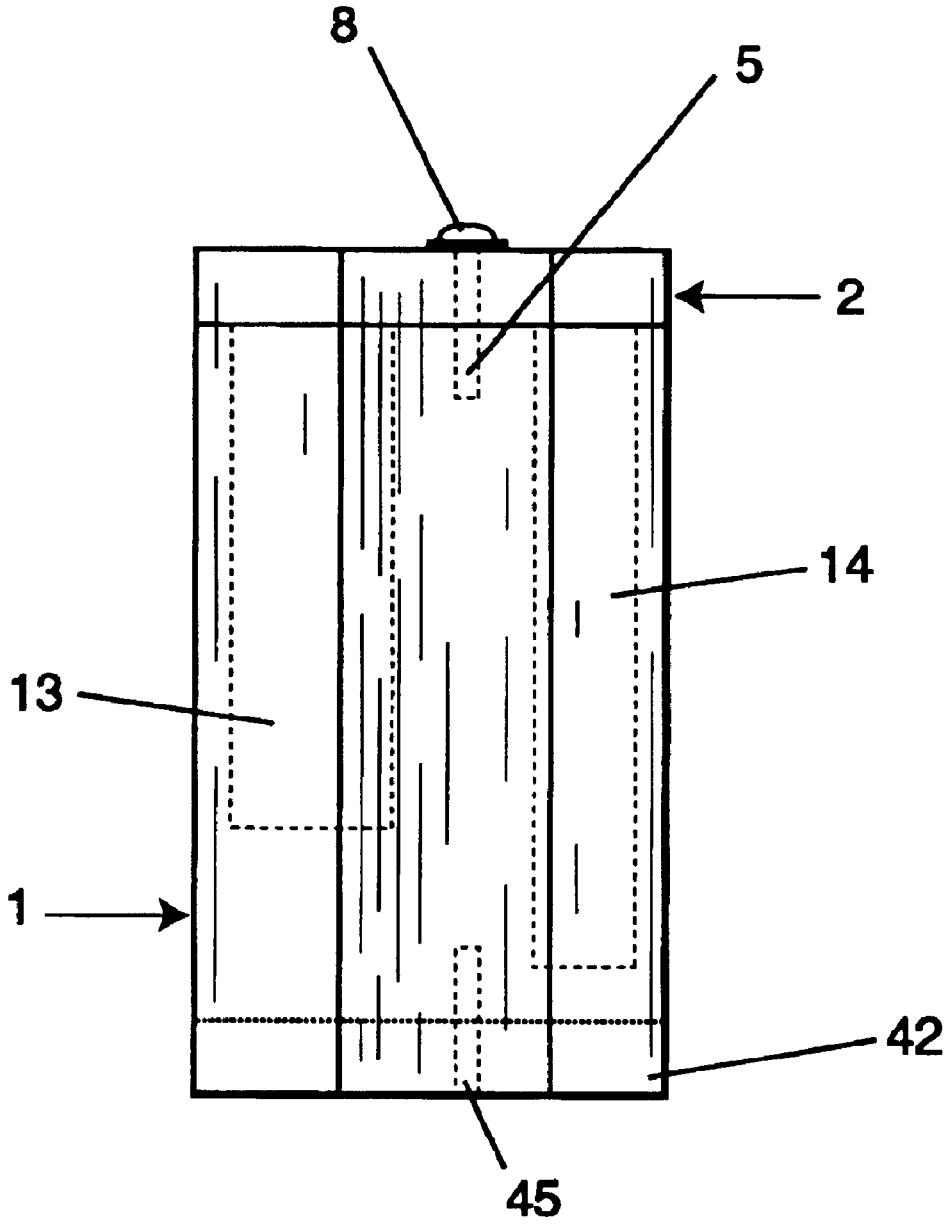
FIG. 21 is a front elevation of the invention with the attachment hole, smoking material receptacle, and pipe receptacle and replacement lid shown in phantom.
Figure 22:
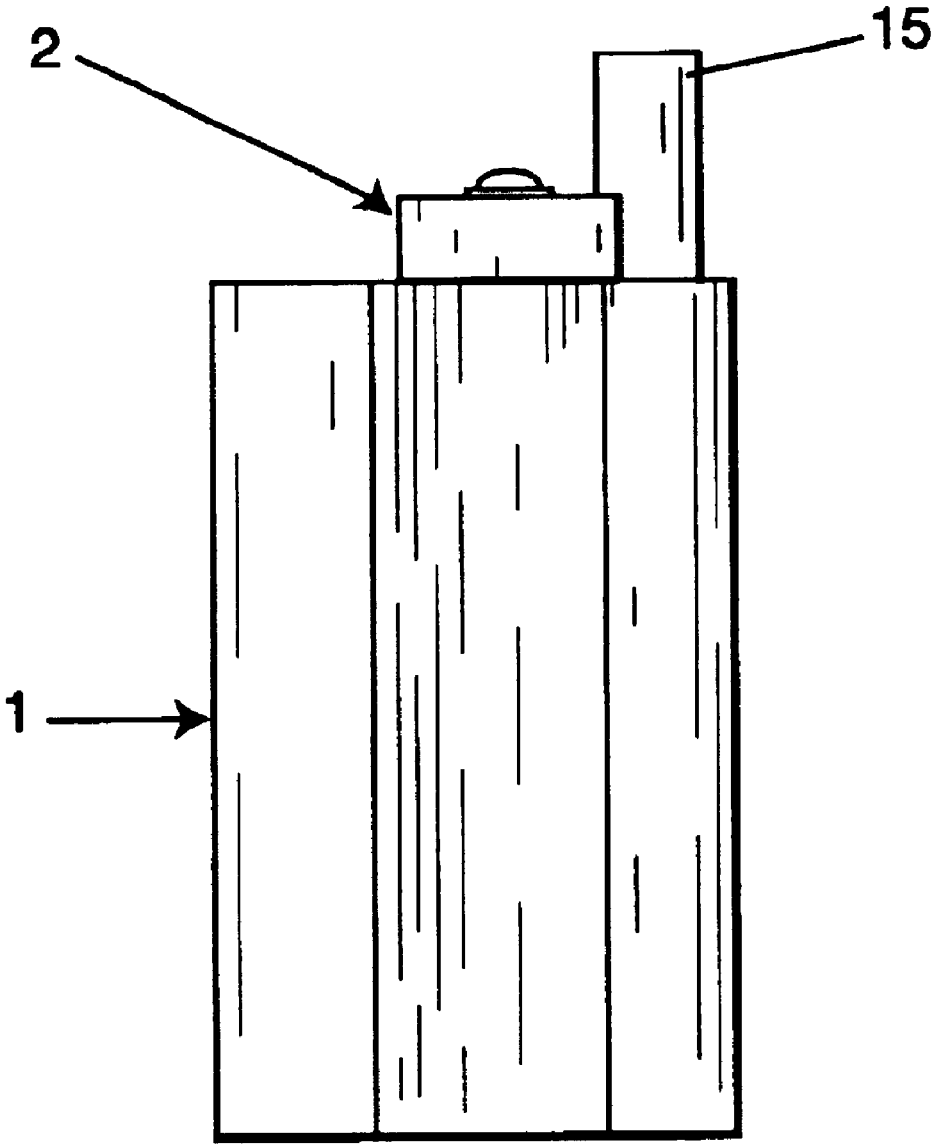
FIG. 22 is a front elevation of the invention with the lid in an open position and a pipe extending above the top edge of the smoking apparatus body.

A second optional aspect of the invention to strengthen the structural integrity of the lid is a thin metal plate adhered to the lid. In one embodiment of the invention the metal plate is adhered to the underside of the lid and covers the openings in the body when the lid is in the closed position As is seen in FIG. 21 there is a section at the bottom of the apparatus body below the bottom of both of the bores for the smoking material receptacle and pipe receptacle, indicated in FIG. 21 as below the horizontal phantom line. In a further variation on the above-described embodiments, the body is made sufficiently long to provide for a replacement lid section in the event the original lid is lost or broken. This may be preformed and attached to the bottom of the body, or the user can simply be provided instructions on cutting off a section of the bottom to create a replacement lid should the need arise This replacement lid section is shown at 42 in FIG. 21, and may be attached as by the fastener shown in phantom at 45. The constant shape of the body and lid permits attachment of the replacement lid to the bottom of the body. This is a significant advantage of having the lid, replacement lid, and body external side walls have a shape and contour which do not change along a linear direction from the top of each to the bottom of each, and to having these respective components alignable such that there is no such change among them. There is therefore optionally a replacement lid section extending upwardly from the smoking apparatus body bottom.

From the foregoing description it is seen that in one aspect the invention is a method for manufacturing a compact wooden smoking apparatus. The method involves milling an elongate piece of wood to impart a shape and a contour which do not change along a linear direction from a first end of the piece of wood to a second end of the piece of wood, thereby yielding a wooden blank for further processing. In one embodiment the contour(s) has a uniform depth and uniform width and is formed by the removal of wood and extends from the top of the lid to the bottom of the body bottom. One particular preferred method involves milling to provide a contour having a generally arcuate shape as shown in FIGS. 11 and 13. Then lateral sections of a first length are cut from the wooden blank to produce a plurality of smoking apparatus body sections. A smoking material receptacle is bored into each of the plurality of smoking apparatus body sections. A lid is fastened to each of the plurality of smoking apparatus sections to provide a smoking material receptacle closure for each of the plurality smoking apparatus body sections. In a preferred embodiment lateral sections of a second, shorter length are cut from the elongate piece of wood to produce the smoking apparatus lids.

The foregoing relates only to a limited number of embodiments that have been provided for illustration purposes only. It is intended that the scope of invention is defined by the appended claims and there are modifications of the above embodiments that do not depart from the scope of the invention.

What is claimed is:

1. A compact wooden smoking apparatus comprising:

a smoking apparatus body having a body top, a body bottom, and body external side walls;

wherein the body has a constant peripheral contour in cross sections taken in any plane generally parallel to the body top and body bottom;

a smoking material receptacle in the body having a smoking material receptacle opening at the body top;

a pipe receptacle separate from the smoking material receptacle; and a lid for the smoking material receptacle, the lid having a lid top, a lid bottom, a lid width, lid depth, and lid external walls;

wherein the lid has a constant peripheral contour in cross sections taken in any plane generally parallel to the lid top and lid bottom; and a replacement lid section extending upwardly from the smoking apparatus body bottom, the replacement lid section having a constant peripheral contour in cross sections generally parallel to its top and bottom, which constant peripheral contour corresponds to the constant peripheral contour of the body, such that when the replacement lid is attached to the body, the lid and body are alignable such that the compact smoking apparatus including body and replacement lid section has a constant peripheral contour in cross sections from the body top through the replacement lid.

* * * * *